US005980355A

United States Patent [19]

Shih

[11] Patent Number: 5,980,355

[45] Date of Patent: Nov. 9, 1999

[54] TRANSMISSION MECHANISM FOR MUSIC BOX ORNAMENT

[76] Inventor: Barry Shih, 2F, No.321, PaTeh Rd., Sec.4, Taipei, Taiwan

[21] Appl. No.: 09/078,210

[22] Filed: May 12, 1998

[51] Int. Cl.[6] ..... G10F 1/06

[52] U.S. Cl. ..... 446/298; 84/95.2; 74/50

[58] Field of Search ..... 446/81, 298, 404; 84/94.1, 94.2, 95.1, 95.2; 74/50

[56] References Cited

U.S. PATENT DOCUMENTS

| | | | |
|---|---|---|---|
| 4,987,787 | 1/1991 | Hou | 74/49 |
| 5,134,777 | 8/1992 | Meyer et al. | 74/50 |
| 5,255,461 | 10/1993 | Chiou | 84/94.2 |
| 5,331,110 | 7/1994 | Chen | 84/94.1 |
| 5,342,988 | 8/1994 | Hsu et al. | 84/95.1 |
| 5,459,278 | 10/1995 | Hsu | 446/298 |
| 5,510,569 | 4/1996 | Liu | 84/95.1 |
| 5,523,523 | 6/1996 | Chen | 84/95.2 |
| 5,525,747 | 6/1996 | Hsu et al. | 446/298 |
| 5,532,423 | 7/1996 | Liu | 446/298 |
| 5,571,979 | 11/1996 | Chen | 446/298 |

*Primary Examiner*—Robert A. Hafer
*Assistant Examiner*—Jeffrey D. Carlson
*Attorney, Agent, or Firm*—W. Wayne Liauh

[57] ABSTRACT

A transmission mechanism for music box ornament includes a music box which houses therein a wind-up spring and a barrel as a power source, a holding frame attached to the body has a pair of spaced flanges holding a sleeve therebetween and a drive wheel attached to the spindle of the barrel having a stub slidably engages with a slot in a motion bar. The motion bar has a finger attached to a bottom end of a tappet rod which moveably runs through the sleeve. The sleeve has an axial slit on a lateral wall to enable the finger to move axially up or down. There is an ornament attached to the top end of the tappet rod. When the wind-up spring is activated and music is sound, the spindle rotates and turn the drive wheel which in turn moves the tappet rod up or down through the holding bar. The tappet rod moves in the sleeve smoothly and steadily. The ornament attached to the tappet rod also is moved up or down steadily to create amusement effect.

6 Claims, 5 Drawing Sheets

TRANSMISSION MECHANISM FOR MUSIC BOX ORNAMENT

BACKGROUND OF THE INVENTION

1. Field of the Invention

This invention relates to a transmission mechanism for music box ornament and particularly to a simple and low cost motion transmission mechanism driven by the music box power source for moving the ornament smoothly.

2. Description of the Prior Art

Music box with a moveable ornament is a popular gadget, particularly among young ladies and girls. U.S. Pat. No. 4,987,787 discloses one of the commonly used transmission mechanisms for moving the ornament in a music box. Referring to FIG. 1, it mainly includes a casing A for housing a conventional music box gears therein and supporting an ornament thereon. Within the casing A, there is a drive wheel C with an eccentrical drive stub B which slidably engages with a slot J of a slide link F. The slide link F is supported at two ends by a pair of spaced and vertical guide rods D. Each guide rod D has a coil spring E cushion at the lower portion. The drive wheel C is driven and turned by a conventional wind-up power source of the music box. A tappet rod H has its bottom end attached to the slide link F and its top end engaged with the ornament.

The rotating drive wheel C and the drive stub C move the slide link F up or down reciprocally. The ornament attached to the top of the tappet rod H thus will also be moved reciprocally up or down to create amusement effect while music is sound.

The prior art set forth above has some drawbacks. For instance the coil springs E are for keeping the drive stub C making constant contact with the slide link F in the slot J. The spring force tends to accelerate the wearing of the stub C and the slot J. When the stub C is moved at either end of the slot J, the spring at another end tends to tilt the slide link at another end, thus the up or down movement of the tappet rod H and the ornament is rough and not smoothly. It also tends to accelerate the wearing of the guide rods D and the slide link F and makes the up and down motion of the tappet rod and the ornament even more unstable after long time of use. Moreover the whole structure is rather complicated and bulky. It is difficult to produce and assemble, and costs higher.

SUMMARY OF THE INVENTION

In view of aforesaid disadvantages, it is therefore an object of this invention to provides a transmission mechanism for music box ornament that is simply structured, small size, easy to produce and assemble, low cost to make, more durable and function more smoothly.

The transmission mechanism according to this invention includes a music box body, a holding frame, a sleeve, a drive wheel, a motion bar and a tappet rod. The tappet rod is moveable up or down in the sleeve. The motion bar is driven up or down directly by the drive wheel with no cushion spring. All this makes the motion of the tappet rod smooth and stable. It also has less wearing between the moving parts and thus can last longer.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
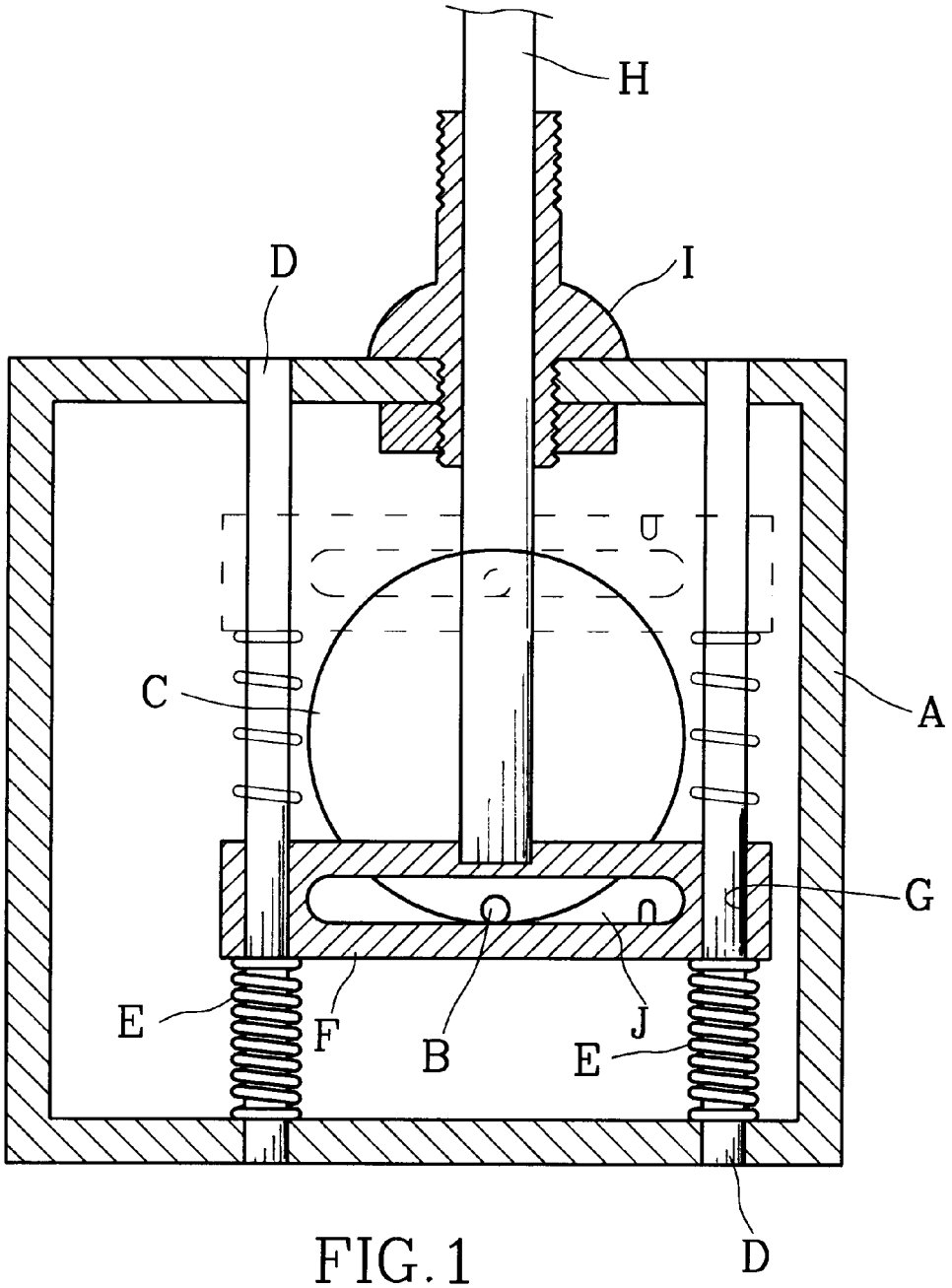
FIG. 1 (PRIOR ART)
FIG. 1 is a sectional view of a conventional music box.
Figure 2:
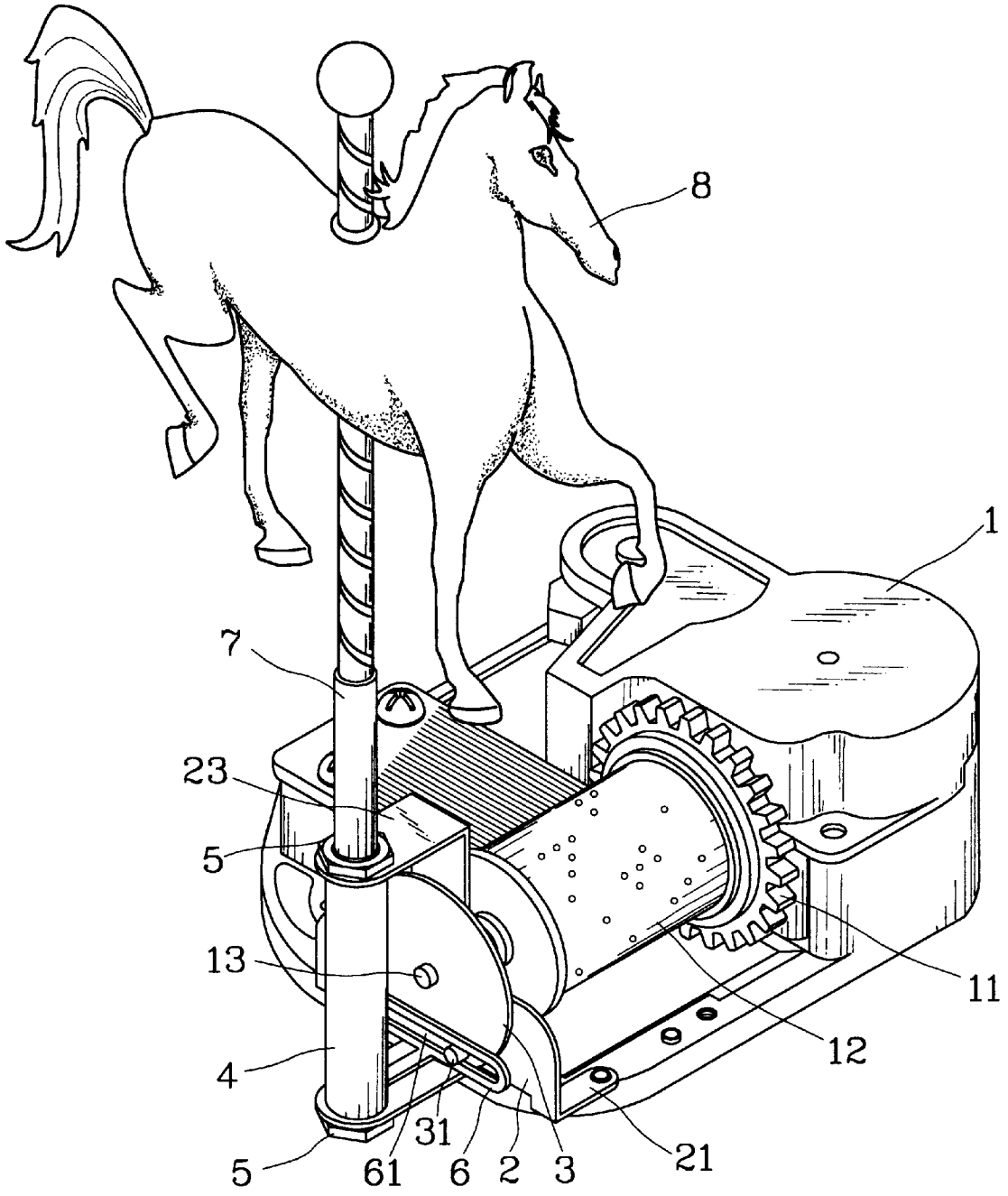
FIG. 2 is a perspective view of this invention.
Figure 3:
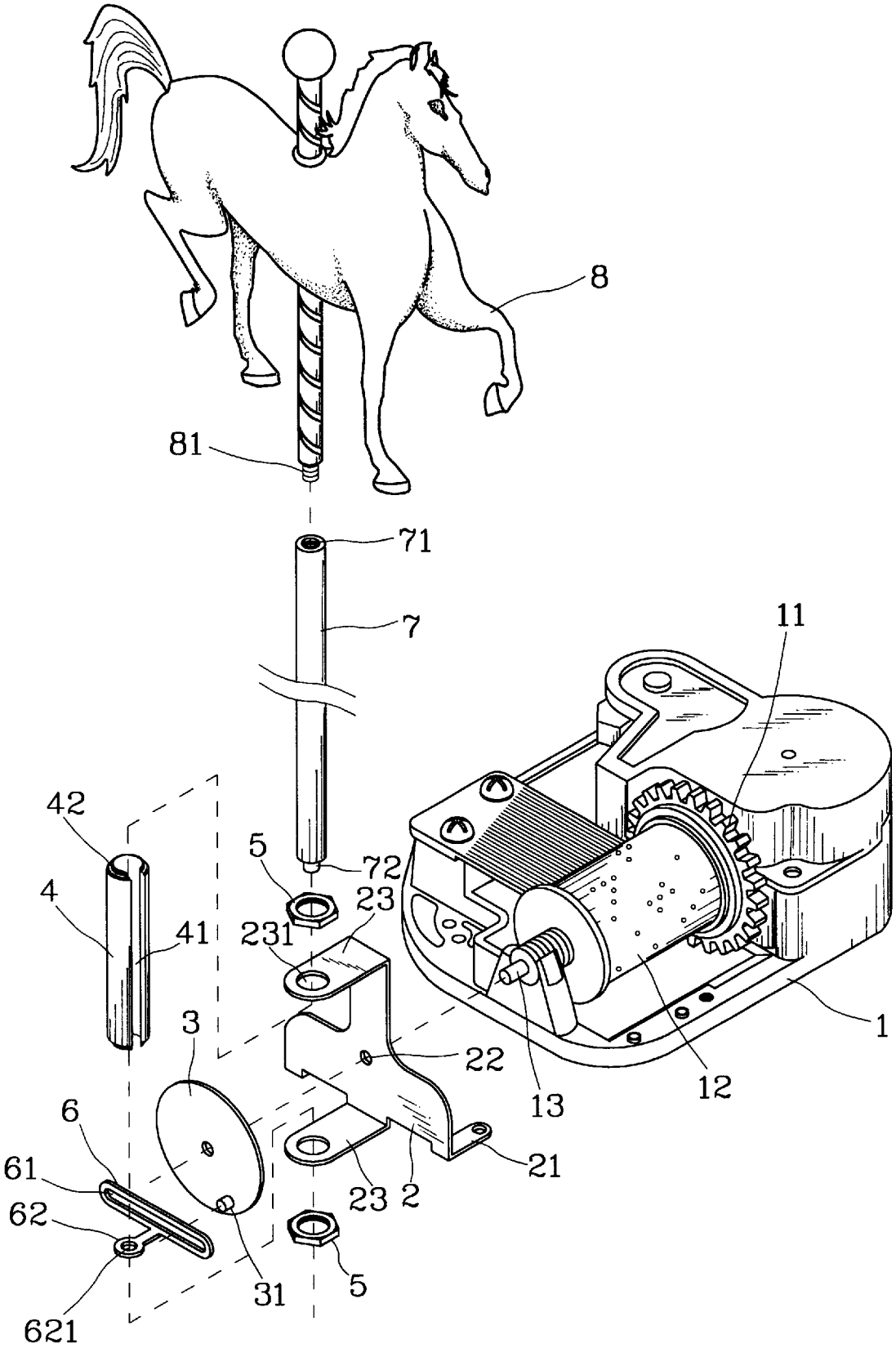
FIG. 3 is an exploded view of this invention.

Referring to FIGS. 2 and 3, this invention includes a music box body 1 which houses therein a wind-up spring (not shown in the figures) as power source to drive a gear set 11 and a barrel 12, a holding frame 2 with two horizontal feet 21 bending inward for attaching to the body 1 and a pair of vertically spaced flanges 23, each flange has a bore 231, a drive wheel 3 with a stub 31 spaced from the center of the wheel, a motion bar 6 with a transverse slot 61 and a horizontal finger 62 with a finger end in which an aperture 621 is formed, a sleeve 4 with screw threads at both ends 42 and a slit 41 runs through a lateral wall from top to bottom, the slit 41 is wider than the finger 62. The finger end is smaller size than the inside diameter of the sleeve and a tappet rod 7 which has a bottom end 72 engageable with the aperture 621 and a screw bore 71 at the top end engageable with a screw end 81 of an ornament 8.

The barrel 12 has a power spindle 13 running through an opening 22 in the holding frame 2 and engages with the drive wheel 3 at one side. The stub 31 is on another side of the drive wheel 3. The sleeve 4 is held between the two flanges 23 and has its both ends 42 running through the bores 231 respectively and being secured tightly by nuts 5 at both ends. The tappet rod 7 runs through the sleeve 4 and has its bottom end 72 engaged with the motion bar 6 (at the aperture 621). The stub 31 engages with the slot 61 and is moveable transversely therein. The stem of the finger 62 is moveable up or down in the slit 41 of the sleeve 4.

Figure 4:
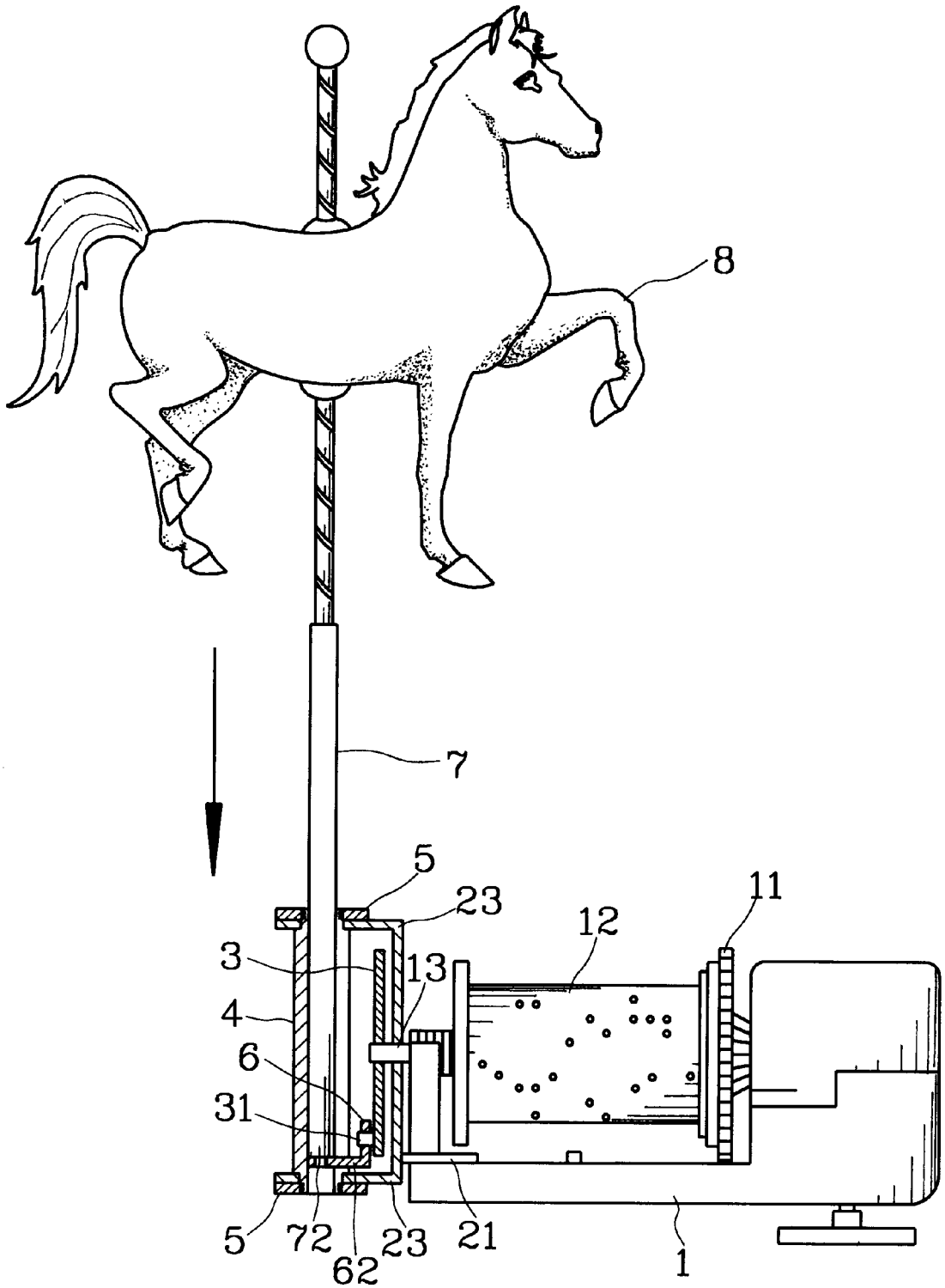
FIG. 4 is a side view partly cut away, of this invention in use.
Figure 5:
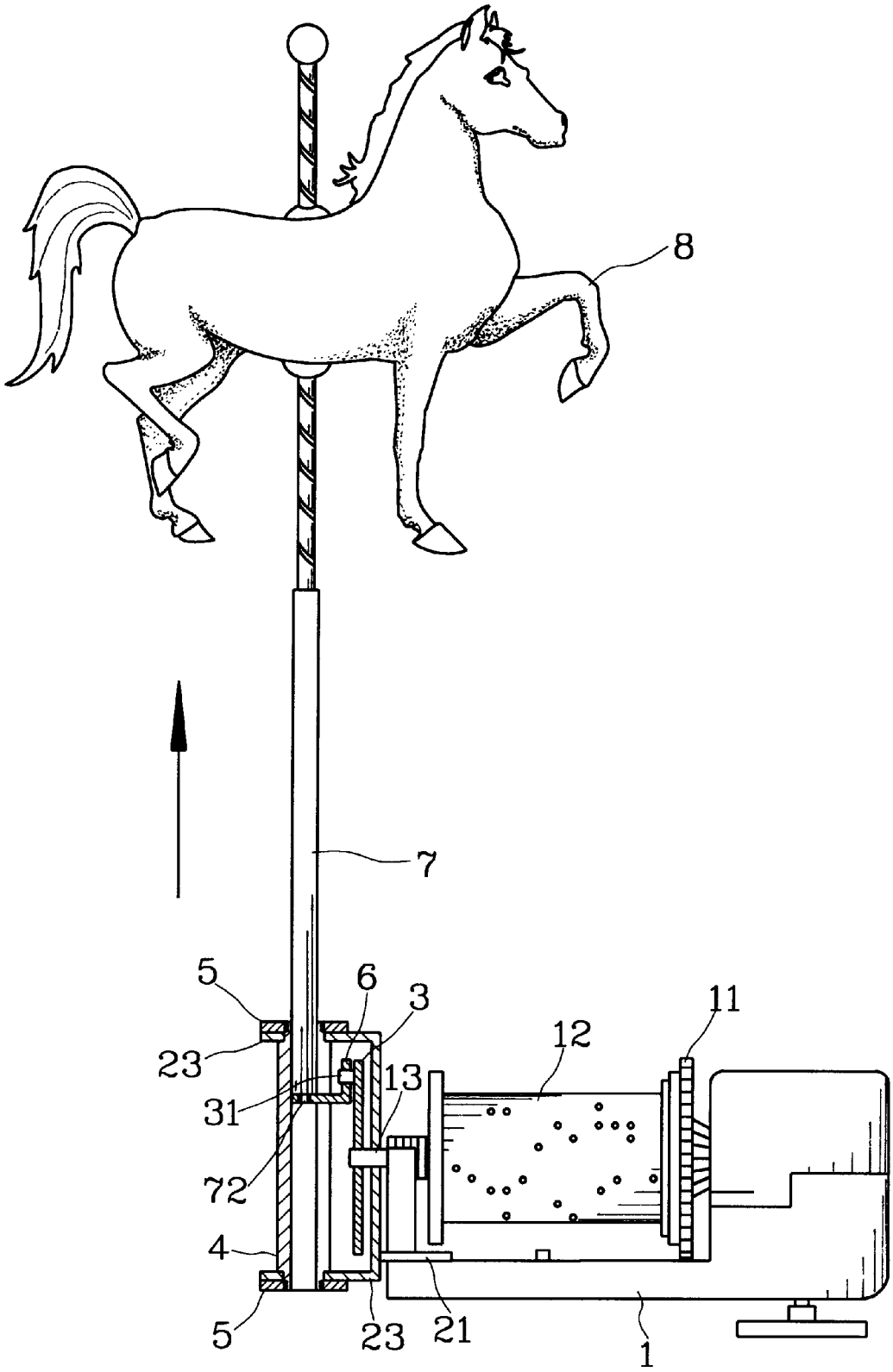
FIG. 5 is another side view, partly cut away, of this invention in use.

By means of the structure and construction set forth above, when the wind-up spring is activated, the gear set 11, the barrel 12 and its spindle 13 rotate. The drive wheel 3 is turned accordingly. The stub 31 moves in a circle but is converted to a reciprocally transverse motion in the slot 61 and thus moves the motion bar 6 up or down reciprocally (also refer to FIGS. 4 and 5). The tappet rod 7 and the ornament 8 then will be moved reciprocally up or down. Therefore when the music is sound, the ornament 8 will be set to motion simultaneously to create amusement effect desired.

Since the tappet rod 7 is moving up or down in the sleeve 4, the up or down motion is much more steady and smooth than a conventional one. There is no cushion spring to press the motion bar against the stub 31, the reciprocal motion of the stub 31 in the slot 61 is also smooth without too much friction or wear. The whole structure is more compact and simpler than a conventional one. It is less expensive to produce and has longer durable life.

What is claimed is:

1. A transmission mechanism for music box ornament comprising:

a music box body including a power source which includes a wind-up spring, a gear set and a barrel with a spindle;

a holding frame fixed to the music box body having an opening for the spindle to pass through and a pair of vertically spaced flanges, each flange having a bore formed therein;

a drive wheel engaged with the spindle at the center of one lateral wall thereof having a stub on another lateral wall and spaced from the center thereof;

a sleeve engageable at two ends with the bores of the flanges having a slit axially formed on a lateral wall thereof;

a motion bar having a transverse slot moveably engageable with the stub, said motion bar having a horizontal finger with a finger end; and a tappet rod axially slidable through the sleeve having a bottom end engageable with the finger end.

2. The transmission mechanism of claim 1, wherein both ends of the sleeve have screw threads.

3. The transmission mechanism of claim 1, wherein the slit faces the drive wheel.

4. The transmission mechanism of claim 1, wherein the outside perimeter of the finger end is less than the circumference of the sleeve.

5. The transmission mechanism of claim 1, wherein the tappet rod has a top end engaged with an ornament.

6. The transmission mechanism of claim 1, wherein the bottom end of the tappet rod has a stud engageable with an aperture formed in the finger end of the motion bar.

* * * * *